US006327843B1

(12) United States Patent
Cipparrone et al.

(10) Patent No.: US 6,327,843 B1
(45) Date of Patent: Dec. 11, 2001

(54) PROCESS AND APPARATUS FOR THE MANUFACTURE OF REINFORCING METALLIC CORD FOR ELASTOMER-MATRIX COMPOSITE ARTICLES

(75) Inventors: Marco Cipparrone, Fiesole; Omero Noferi, San Giovanni Valdarno, both of (IT)

(73) Assignee: Pirelli Coordinamento Pneumatici SpA, Milan (IT)

( * ) Notice: Subject to any disclaimer, the term of this patent is extended or adjusted under 35 U.S.C. 154(b) by 0 days.

(21) Appl. No.: 09/459,998

(22) Filed: Dec. 14, 1999

Related U.S. Application Data

(62) Division of application No. 09/084,895, filed on May 28, 1998, now Pat. No. 6,021,633, which is a division of application No. 08/770,110, filed on Dec. 20, 1996, now Pat. No. 5,797,257.

(30) Foreign Application Priority Data

Dec. 21, 1995 (IT) ..... MI95A2721

(51) Int. Cl.[7] ..... D02G 03/02

(52) U.S. Cl. ..... 57/902; 57/3; 57/58.49; 57/58.52; 57/58.83; 57/58.86; 57/311; 57/352

(58) Field of Search ..... 57/5, 9, 58.49, 57/58.52, 58.83, 58.86, 311, 352, 902

(56) References Cited

U.S. PATENT DOCUMENTS

| | | | | |
|---|---|---|---|---|
| 3,867,809 | * | 2/1975 | Holbrook | 57/58.82 |
| 4,258,543 | | 3/1981 | Canevari et al. . | |
| 4,335,571 | * | 6/1982 | Tarantola | 57/58.52 |
| 4,399,853 | | 8/1983 | Morimoto . | |
| 4,599,853 | * | 7/1986 | Varga-Papp | 57/9 |
| 5,020,312 | | 6/1991 | Watakabe . | |
| 5,109,661 | | 5/1992 | Okamoto et al. . | |
| 5,223,060 | | 6/1993 | Imamiya et al. . | |
| 5,285,623 | | 2/1994 | Baillievier et al. . | |
| 5,338,620 | | 8/1994 | Van Ooij et al. . | |
| 5,370,168 | | 12/1994 | Boiocchi et al. . | |
| 5,408,819 | | 4/1995 | Nishimura et al. . | |
| 5,564,268 | * | 10/1996 | Thompson | 57/3 |

FOREIGN PATENT DOCUMENTS

| | | |
|---|---|---|
| 4337596 | 10/1993 | (DE) . |
| 4373596 | 5/1995 | (DE) . |
| 0168857 | 1/1986 | (EP) . |
| 2034363 | 6/1980 | (GB) . |
| 4370283 | 12/1992 | (JP) . |
| 5117983 | 5/1993 | (JP) . |
| 6108386 | 4/1994 | (JP) . |

OTHER PUBLICATIONS

Research Disclosure, Dec. 1982, No. 22404, "Bi–Diameter construction of steel tire cord".

* cited by examiner

*Primary Examiner*—John J. Calvert
*Assistant Examiner*—Shaun R Hurley
(74) *Attorney, Agent, or Firm*—Stevens, Davis, Miller & Mosher, LLP

(57) ABSTRACT

A cord comprising at least a first pair and a second pair of wires (2*a*, 2*b*) of different diameter randomly disposed in transverse cross section thereof, is obtained by arranging in a nacelle (7) of a double-twisting laying machine, a twister (16) operating upstream of a preformer (15). The twister (16), rotating in a direction opposite to that of the impeller (5) and at a speed which is twice that of the impeller, neutralizes the internal torsional stresses induced in the wires (2*a*, 2*b*) by effect of the double twisting carried out upon the action of the impeller itself. Thus, a better control of the preforming operation executed on the wires (2*a*, 2*b*) disposed parallel in respectively coplanar axes is enabled. The obtained cord (1), within each laying pitch and only under a traction condition involving a load not exceeding 5 kg, has at least one right cross section in which at least one wire (2*a*, 2*b*) is spaced apart from at least one of the adjacent wires so as to facilitate the rubberizing step, by enabling access of the blend to the cross section and penetration thereof along the cord axis. The cord is preferably used as a reinforcing element for the belt structure.

7 Claims, 3 Drawing Sheets

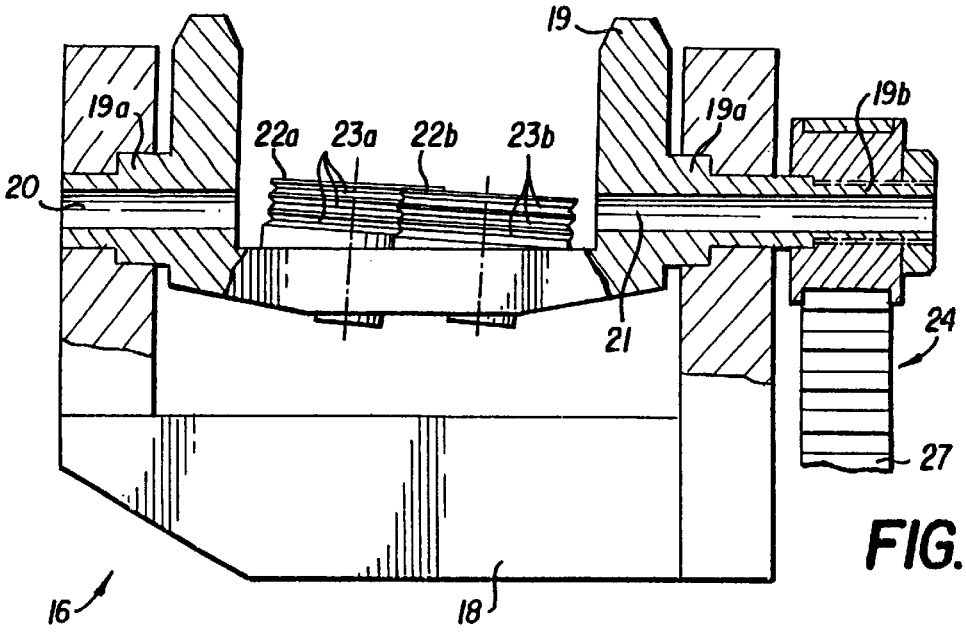
FIG. 3
FIG. 6
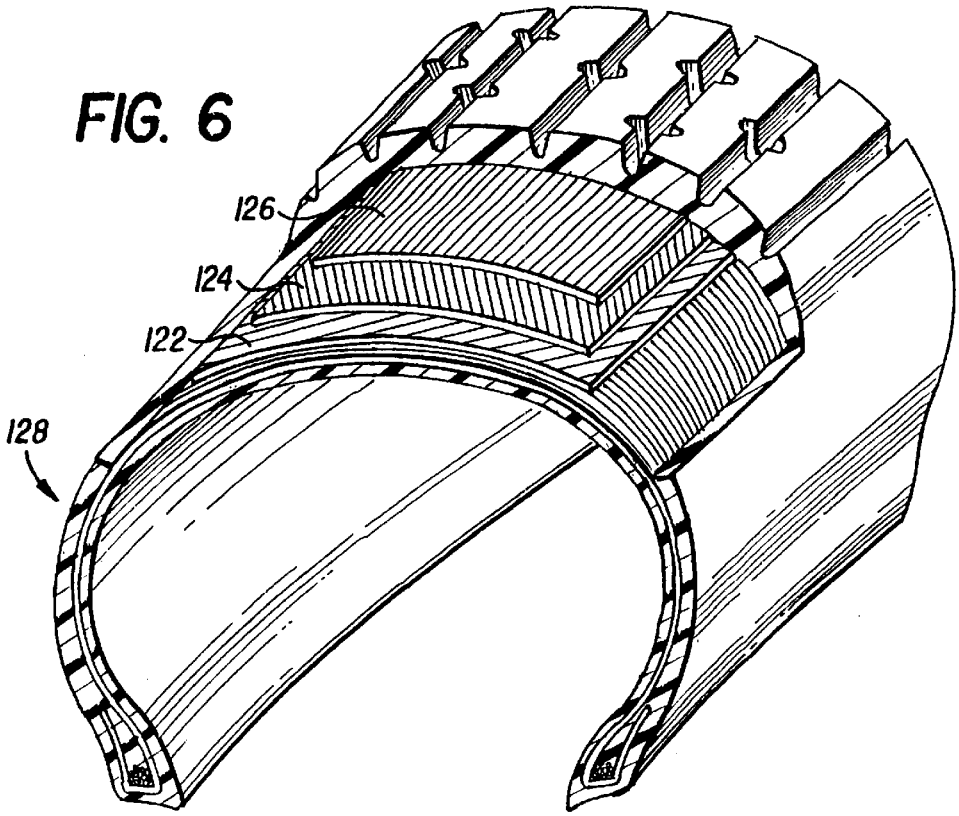

PROCESS AND APPARATUS FOR THE MANUFACTURE OF REINFORCING METALLIC CORD FOR ELASTOMER-MATRIX COMPOSITE ARTICLES

This application is a divisional of U.S. patent application Ser. No. 09/084,895, filed May 28, 1998 now U.S. Pat. No. 6,021,633, which is a divisional of U.S. patent application Ser. No. 08/770,110, filed Dec. 20, 1996 now U.S. Pat. No. 5,797,257, incorporated herein by reference.

BACKGROUND OF THE INVENTION

The present invention relates to a reinforcing metallic cord to be used in particular in elastomer-matrix composite articles of manufacture, specifically in pneumatic tires. The cord comprising a plurality of elementary wires twisted together about the longitudinal axis of the cord, which cord, under any drawing condition with a tractive load not exceeding 5 kg, has at least one right cross-section provided with at least one inlet port to enable access of the elastomer material to the inside of the cord section.

The present invention also concerns a process for the manufacture of said cord, said process comprising the steps of: preforming a plurality of elementary wires, submitting them to a permanent bending set along their longitudinal extension; laying the wires together by a double helical twisting about the longitudinal axis of the cord.

The invention further relates to an apparatus for the manufacture of said cord, said apparatus comprising: a bearing structure; an impeller in engagement with the bearing structure and drivable in rotation according to a given axis; a nacelle oscillatably linked to the bearing structure according to an oscillation axis coincident with the rotation axis of the impeller. The apparatus also has feeding means operatively mounted on said nacelle to feed a plurality of wires from respective supply reels, said wires being guided onto the impeller along a laying path having end stretches coincident with the rotation axis of the impeller and a central stretch spaced apart from said rotation axis. At least one preformer is operatively engaged with the nacelle and acting on the wires over a portion thereof upstream of the first end stretch of the laying path.

The above cord is particularly conceived for use in making tire components for motor vehicles, such as the carcass and/or belt plies for example, but it can be easily employed for the manufacture of other articles as well, such as pipes for high-pressure fluids, belts, conveyor belts or any other article of elastomer-based composite material. The metallic cords usually employed as the reinforcing structure for articles of manufacture of elastomer material are generally comprised of a plurality of wires helically twisted about an axis coincident with the longitudinal extension of the cord. Usually, the cords of this type are made by a laying machine of the so-called double-twisting type, provided with an impeller operatively in engagement with a bearing structure and operable in rotation by motor means, as well as a so-called nacelle oscillatably linked to the bearing structure along an axis coincident with the rotation axis of the impeller. The nacelle carries a plurality of supply reels on which the wires have been previously wound, which wires through appropriate feeding and guide means are picked up and guided onto the impeller along a predetermined laying path. This laying path has a first end stretch coincident with the rotation axis of the impeller, a central stretch stepping over the impeller so as to be spaced apart from the rotation axis, and a second end stretch again coincident with the above specified rotation axis.

Rotation of the impeller gives rise during two successive steps and at the end stretches of the laying path, to twisting of the wires and, as a result, formation of the cord, according to a helical winding pitch depending on the relation existing between the rotation speed of the impeller and the pulling speed imposed to the wires upon the action of collecting means usually operating downstream of the laying machine, directly on the cord.

Generally, before being submitted to twisting the wires are subjected to a preforming step by their passage over a preforming device imposing a permanent bending set to the wires themselves, in order to promote the subsequent arrangement of the wires in a helical form to ensure maintenance of the structural compactness of the cord.

The foregoing being stated, in order to eliminate the risk that the cords may undergo undesired corrosion phenomena once they have been introduced into the tire or another article of manufacture of elastomeric material, it is of the greatest importance that the wires forming the cords should be completely coated, over the whole surface extension thereof, with the elastomeric material into which the cord itself is incorporated.

The above result, which is increasingly more difficult to achieve with the increasing of the structural complexity of the cord, cannot be easily attained even when the cords have a low number of wires, which solution, due to the light weight involved, is of particular interest in the production technology of motor vehicle tires.

Said difficulty originates from the fact that, in order to give the cord the necessary geometric and structural stability, the wires are usually intimately compacted in contact with each other, so as to confine one or more closed cavities extending longitudinally within the cord. These cavities clearly cannot be easily reached by the elastomer material during the usual rubberizing steps of the cord.

When for instance, as a result of cuts or punctures caused in the tire structure or for any other reason, humidity and other external agents can penetrate into said cavities, a quick corrosion process of the wires inevitably occurs, to the detriment of the structural resistance of the cord and the tire as a whole.

In an attempt to overcome this problem, so-called "swollen" cords have been proposed, that is, cords in which the wires (generally three to five in number) are maintained always spaced apart from each other during the rubberizing step, carried out by known processes that keep the tractive load applied to the cord to values not exceeding five kilos. An example of these cords is given in the Italian Patent No. 1,099,869 of the assignee.

The result of a complete rubberizing of the wires is thus achieved, but the cords of this type have some use problems in that the wires keep spaced apart from each other also when the cord is submitted to a strong tensile stress during the tire manufacture and when the tire is run, and this condition causes an undesired geometric and structural instability of the cord as a whole, which is substantially prejudicial to the tire behavior.

Alternatively, cords have been proposed which have still a low number of wires, in which at least one strand is deformed so as to acquire a broken line course, such as those described in the U.S. Pat. No. 5,020,312.

In this manner, a continuous contact between at least two adjacent wires along the longitudinal extension of the cord is made impossible, thereby maintaining separation areas between said two wires, that is, ports for admittance of the rubberizing material, at each zig-zag bending of the strand.

A drawback present in this type of cords is a decay in the fatigue resistance values and a consequent decay in the quality of the tire.

Finally, the use of so-called dual diameter cords has been proposed, that is, cords provided with two pairs of wires in which the strand diameter of one pair is suitably differentiated from that of the other pair.

In this connection, publication RD 22 404 points out that such a cord, to be obtained by usual laying machines of the above described double-twisting type causes the important central cavity, which is defined internally of the cords provided with four or five wires of same diameter, to be replaced by two opposite cavities of much more reduced sizes, that can be more easily filled with the elastomer material used for rubberizing.

In spite of this size reduction, said cavities are in any case closed to the outside. This condition makes it difficult to cause the elastomer material to penetrate into the inner parts of the cord section.

Patent EP 0 168 857 discloses a metallic cord for the manufacture of which one pair of wires of the same diameter and a second pair of wires of a smaller diameter than that of the first pair, are fed to a conventional internal collection laying machine, after passing through a circular preforming head where the wires of the first and second pairs follow specific paths to be submitted to preforming in a suitably differentiated manner with respect to each other.

The cord thus achieved has the pair of wires of greater diameter helically twisted together in a mutual contact relationship, whereas the wires of the second pair are each inserted between the two wires of the first pair and extend parallel to the latter, while maintaining suitably spaced apart therefrom.

In this manner, the presence of closed cavities in the transverse section of the cord is eliminated and, as a result, the complete coating of the wires with the elastomer material employed during the rubberizing step is ensured.

However, the wires of smaller diameter keep spaced apart from those of greater diameter also when the cord is subjected to tensile stress under use conditions, which, as in the swollen cords, will cause a certain geometric and structural instability of the cord as a whole, said instability being undesirable.

In addition, it is very difficult to give the cord a precise and regular geometric configuration at each point of its longitudinal extension, in that constancy in the mutual positioning of the wires in the cord is ensured by the particular type of preformer used, but distance of the wires of smaller diameter from those of greater diameter tends to vary randomly at the different points of the longitudinal extension thereof, both under rest conditions and under use conditions of the cord.

SUMMARY OF THE INVENTION

In accordance with the present invention, it has been found that by using roller-type preformer and arranging a twister device upstream of the preformer, which device is adapted to submit the wires to a preliminary step involving successive twisting and untwisting operations, it is possible to obtain a finished cord having the wires-arranged in a random order in the transverse section. Thus under rest conditions, that is under conditions of weak pulling, for each pitch there is at least one inlet port for the elastomer material, so as to ensure the complete coating of the wires during the rubberizing step, while at the same time eliminating the inner torsional stresses from the wires passing on the preformer. This procedure obtains a cord substantially free of internal stresses so that the following working operations of the semifinished products and/or manufacture of the articles containing said cords are facilitated. Afterwards, during the vulcanization operation of the article of manufacture and the practical use of same, the cord is submitted to high tensile stresses, higher than those used in the rubberizing step of the cords, the wires each lie in contact with at least two of the other wires, so as to give the cord a closed and compact structure with an excellent geometric stability.

In particular, the invention relates to a metallic reinforcing cord, to be used especially in elastomer matrix composite articles of manufacture, characterized in that under any traction condition with a tractive load not exceeding 5 kg in the extension of a laying pitch, has at least one right cross section with at least one inlet port enabling access of the elastomer material to the inside of the cord section whereas in use, with tractive loads exceeding 5 kg, at any right cross section of the cord each strand is intimately in contact with at least two of the other wires, causing elimination of said access ports and a structural compaction of the cord itself. In more detail, the subject cord comprises a first pair of wires having a given diameter, and a second pair of wires having a smaller diameter than the first pair of wires.

According to the invention, the cord, at any portion included within a laying pitch, both under rest conditions (traction lower than 5 kg) and under work conditions, has at least one right cross section in which the wires of the second pair are located on the same side with respect to the direction joining the centers of the first pair wires, and at least one right section in which the wires of the second pair are located on opposite sides with respect to said direction joining the centers of the first pair wires.

It is also provided that in one and the same right cross section, by progressively varying the applied tractive load from 0 to 5 kg, the wires of the second pair alternately pass from one situation in which they are both disposed on the same side with respect to a direction joining the centers of the first pair wires to a situation in which they are disposed on opposite sides respectively, with respect to said direction.

Preferably, the wires of the first pair have a diameter between 0.20 mm and 0.40 mm, whereas the wires of the second pair have a diameter between 0.12 mm and 0.30 mm, the difference between the minimum and maximum diameters of said wires being in the range of 0.02 to 0.10 mm.

Still in a preferred embodiment, the cord in reference under rest conditions has a maximum diameter between 1.15 mm and 1.27 mm and a minimum diameter between 0.48 mm and 0.54 mm.

It is also an object of the present invention to provide a process for the manufacture of the above cord, characterized in that before the preforming step the wires are submitted to a torsion action about their own axes, of a quantity substantially equal to that of the double twisting produced on the wires during the laying step.

Thus the torsional stresses induced in the wires by effect of said laying step are neutralized, so that said wires can be submitted to the preforming step carried out with said wires disposed in parallel in side by side relation with respect to each other, in the absence of said internal torsional stresses.

Advantageously, preforming is executed by making the individual wires, disposed parallel and in coplanar relation with each other, take respective preforming paths each having a specific radius of curvature.

Another aspect of the invention is an apparatus for the manufacture of said cord, characterized in that it comprises at least one twister operatively mounted on said nacelle and operating on at least one of said wires at a portion thereof upstream of the preformer to submit the wires to a previous torsional action about their longitudinal axes, aiming at neutralizing internal torsional stresses subsequently induced in the wires by the double twisting produced by said impeller during the laying process.

Advantageously, the twister comprises: one fixed frame rigidly in engagement with said nacelle; one rotating frame rotatably in engagement with the fixed frame according to a rotation axis substantially coincident with one stretch of the feeding path of the wires to the preformer; and a pair of winding rollers rotatably carried by the rotating frame according to respectively parallel axes, said wires being wound one or more times in succession about the first and second winding rollers in opposite directions; driving means to operate the rotating frame in a rotation direction opposite to the rotation direction of the impeller.

Preferably, said driving means kinematically connects the rotating frame with the impeller, so that driving in rotation of the rotating frame is correlated with driving in rotation of said impeller.

In more detail, the driving means actuates the twister at a speed which is twice the rotation speed of the impeller.

According to another feature of the invention, said preformer has a plurality of preforming seatings, each of them being suitably arranged for operatively engaging a respective wire.

In more detail, the preformer consists of an idler roller, said preforming seatings consisting of circumferential races formed in said roller. Each of said circumferential races is substantially as wide as the diameter of the corresponding strand or wire and has a bottom portion of semicircular profile, the axis of which is in coplanar relation with that of the bottom portions of the other circumferential races.

In a further and different aspect, the invention also relates to a pneumatic tire containing structural elements reinforced with cords of the above type.

BRIEF DESCRIPTION OF THE DRAWINGS

Further features and advantages will become more apparent from the detailed description of a preferred embodiment of a metallic reinforcing cord for elastomer matrix composite articles of manufacture, and of a process and apparatus adapted to manufacture said cord. This description is with reference to the accompanying drawings, given by way of non-limiting example, in which:

FIG. 3 is a side view partly in section and to an enlarged scale with respect to the preceding figures, of a twister device which is part of the apparatus of the invention;

FIG. 6 is a perspective view, partially in section, of a tire including the reinforcing wires of the invention.

DETALIED DESCRIPTION OF PREFERRED EMBODIMENT

Referring particularly to the drawings, numeral 1 generally identifies a reinforcing metallic cord for use in elastomer matrix composite articles of manufacture, specifically in pneumatic tires for motor vehicles. In a manner known per se, a tire for vehicle wheels comprises a carcass of toric form having a crown region, two axially opposite sidewalls terminating at radially internal beads for anchoring of the tire to a corresponding mounting rim. Said beads are each reinforced with at last one annular metal core, usually referred to as bead core. The carcass comprises at least one rubberized fabric ply having its ends turned over and around said bead cores, and optionally other reinforcing elements such as flippers, strips and bands of rubberized fabric. Said carcass further has a tread band disposed about its crown and molded with a raised pattern designed to contact a roadway while the tire is running, and a belt structure, interposed between said tread band and said at least one carcass ply and comprising one or more rubberized fabric strips reinforced with textile or metallic cords, the strips being arranged in layers in which the cords are differently inclined in the corresponding strips, relative to the circumferential direction of the tire.

In a manner also known per se, the cord 1 comprises a plurality of wires 2*a*, 2*b*, preferably made of steel having a carbon content of 0.65% to 0.95%, helically twisted about the longitudinal axis of the cord. More particularly, in a preferred embodiment of the present invention, provision is made for a first pair of wires 2*a* preferably of a diameter between 0.20 mm and 0.40 mm and a second pair of wires 2*b* of a diameter between 0.12 mm and 0.30 mm, and in any case smaller than that of the wires 2*a* of the first pair.

In each pair, the wires could also have different diameter, but preferably they have the same diameter; in a convenient embodiment of the invention, the diameters are 0.30 mm and 0.25 mm, respectively.

The diameter difference between the wire of larger diameter and that of smaller diameter is between 0.01 and 0.28 mm, preferably between 0.02 and 0.10 mm and most preferably between 0.03 and 0.05 mm.

That being stated, before analyzing in detail the peculiarity and construction features of the cord 1 according to the invention, the process and apparatus for the manufacture of same will be described hereinafter.

Figure 1:
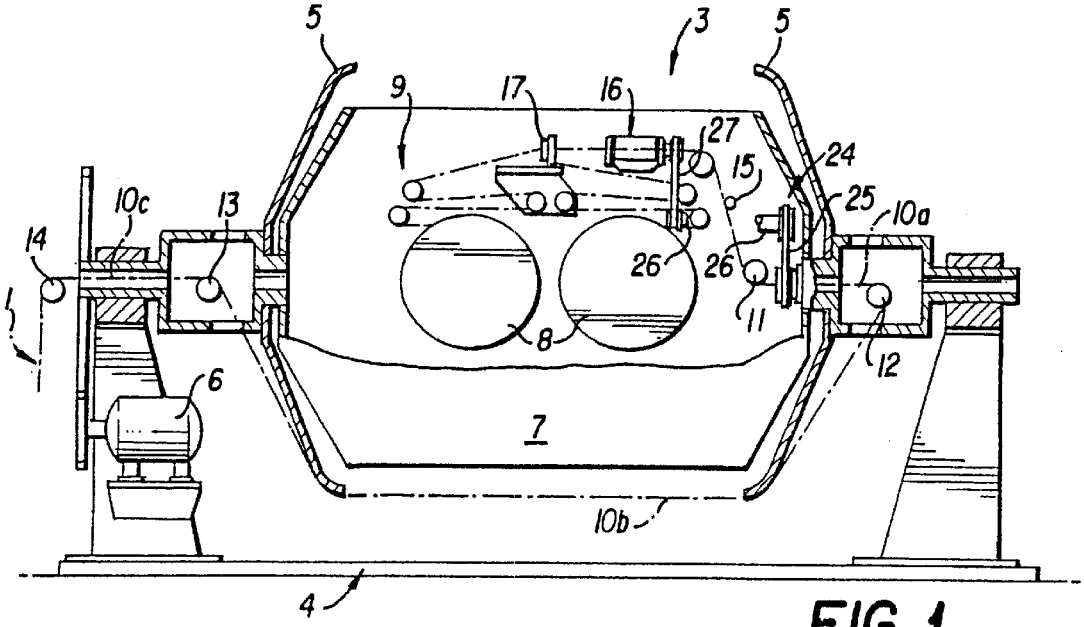
FIG. 1 is a diagrammatic side view, partly in section, of an apparatus of the manufacture of cords according to the present invention.
Figure 2:
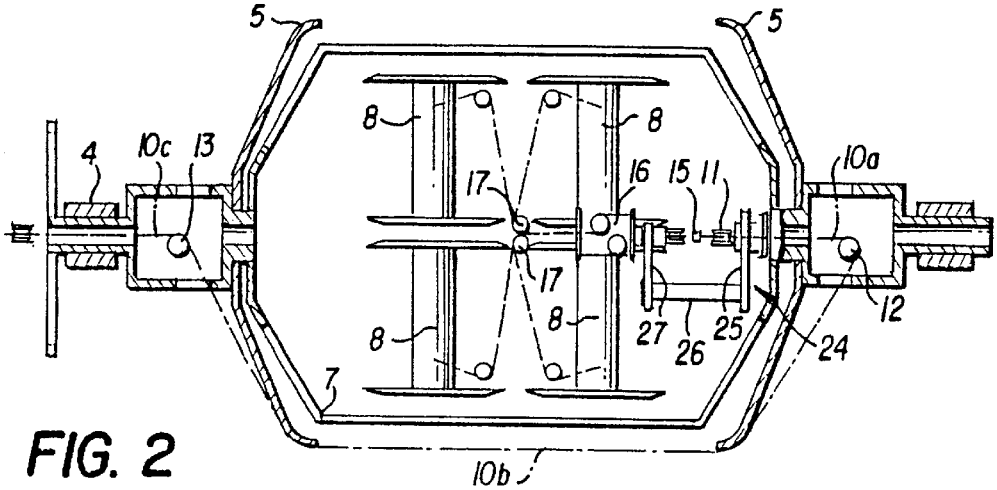
FIG. 2 is a top view of the apparatus shown in FIG. 1.

Refer ring particularly to FIGS. 1 and 2, the apparatus for the manufacture of the reinforcing metallic cord 1 is generally denoted by numeral 3. This apparatus, in a manner known per se, comprises a bearing structure 4 with which a so-called impeller 5 is rotatably in engagement, which impeller is drivable in rotation by a motor 6 or equivalent means. Also oscillatably connected to the bearing structure 4, in correspondence with the rotation axis of the impeller 5, is a so-called nacelle 7 with which a plurality of supply reels 8 is operatively in engagement, at least one of said wires 2*a*, 2*b* is wound on each reel.

Combined with the reels 8 is an appropriate unwinding means 9, only partly shown in a diagrammatic form as it is known per se and conventional, which means is operatively mounted on the inner surface of the nacelle 5 to suitably guide the wires coming from reels 8.

Still in a manner known per se, on issuing from the nacelle 7 the wires 2*a*, 2*b* are guided onto the impeller 5 according to a given laying path along which the formation of the cord 1 by effect of the rotation imposed to the impeller 5 by motor 6, takes place, in combination with a dragging action produced on the cord by collecting means not shown as known and not of importance to the ends of the invention.

In more detail, the laying path is comprised of a first end stretch 10*a* coincident with the rotation axis of the impeller 5 and substantially confined between a first stationary intermediate gear 11 integral with the nacelle 7 and a second rotating intermediate gear 12 integral with the impeller 5. Along said first end stretch 10*a* the wires 2*a*, 2*b* undergo a first helical torsion about the rotation axis of the impeller 5, by effect of the first rotating intermediate gear 12 being driven in rotation by said impeller.

Downstream of the first rotating gear 12, wires 2*a*, 2*b* take a central stretch 10*b* of the laying path extending on the impeller 5 at a radially spaced apart position with respect to the rotation axis thereof, so that they step over the nacelle 7 until they reach a second rotating intermediate gear 13 integrally connected to the impeller.

The laying path finally has a second end stretch 10*c* coincident with the rotation axis of the impeller 5 and extending between the second rotating intermediate gear 13 and a second stationary intermediate gear 14. In this second end stretch, a second torsion of the wires takes place, by effect of the second rotating intermediate gear 13 being driven in rotation by the impeller 5, the formation of the cord 1 being therefore completed, said cord being gradually drawn away from the second stationary intermediate gear 14 upon the action of said collecting means.

The relation existing between the rotation speed of the impeller 5, preferably between 2000 and 6000 rpm, and the dragging speed of the cord 1, and therefore the wires 2*a*, 2*b*, preferably between 60 and 250 m/min, determines the laying pitch value (distance between two adjacent turns), that, is the pitch according to which the wires 2*a*, 2*b* are helically twisted together in the finished cord 1.

In a preferred embodiment of the invention, this laying pitch is maintained to a value between 3 mm and 50 mm, preferably between 6 mm and 30 mm, and in particular equal to 16 mm.

Operatively located along the path taken by the wires 2*a*, 2*b* within the nacelle 7, and more precisely upstream of the first stationary intermediate gear 11, is a preforming member 15 which essentially comprises an idler roller disposed along an axis perpendicular to the feed direction of the wires 2*a*, 2*b*. The wires 2*a*, 2*b*, by being wound on the preformer 15 at an angle between 10° and 180°, preferably of 60°, undergo a permanent bending set aiming at promoting the subsequent laying operations. In accordance with the present invention, however, the individual wires 2*a*, 2*b*, by effect of the double twisting imposed on them at the end stretches 10*a*, 10*c* of the laying path they covered, are each subjected to a torsion about the respective longitudinal axis in the portion thereof extending upstream of the laying path, and more particularly upstream of the first stationary intermediate gear.

These torsions, induced by laying in the individual wires (return torsions), do not allow preforming of the wires to be carried out correctly, that is, by permanent bending set of the wires exclusively along a generatrix of the side surface thereof.

In fact, even if bending of the wires on the preformer 15 takes place along a line parallel to the strand axis, the presence of the internal torsional stresses (the so-called return torsions) deforms said wires, inducing them to take a helical configuration so that the wires are actually preformed according to a helical bending line.

The result is a cord in which the constituent wires keep a stress state hindering the even arrangement of the wires within the predetermined geometric configuration and causing strains in the cord as soon as the corresponding wires are capable of discharging their internal stresses taking a free arrangement in space, which occurs on cutting of the cord, close to the cut end.

In particular, these strains consist in curling of the cord end portion and fraying out of the cord end and represent a serious inconvenience as regards the whole working process, above all the cutting operations of the rubberized fabrics containing said cords, and a source of serious defects in the finished product. of these return torsions induced in the individual wires. To this end, still in accordance with the present invention, apparatus 3 comprises a twister 16 operatively mounted on the inner surface of the nacelle 7 and operating on a portion of the wires 2*a*, 2*b* immediately upstream of the preformer 15.

More particularly, twister 16 operates between the preformer 15 and a pair of opposed intermediate rollers 17 to which the individual wires 2*a*, 2*b* come, being fed by the respective supply reels 8. Twister 16 essentially comprises, as best shown in FIG. 3, a support frame 18 fixedly supported by the nacelle 7 and rotatably engaging a rotating frame 19. Engagement between the rotating frame 19 and support frame 18 takes place at end hub-shaped elements 19a coaxially passed through by an inlet channel 20 and an outlet channel 21 through which the wires are caused to run, in such a manner that the rotation axis of the rotating frame 19 is substantially coincident with a stretch of the feeding path of said wires to the preformer, that is, the longitudinal extension of the wires within said channels 20, 21.

Mounted on the rotating frame 19 is a first and a second freely rotating winding rollers 22*a*, 22*b* having parallel axes, preferably slightly inclined to the normal of the rotation axis of the rotating frame.

As shown in FIG. 3, the winding rollers 22*a*, 22*b* are disposed tangentially on respectively opposite sides in relation to the rotation axis of the rotating frame 19 and, as shown in FIG. 3, they each have at least one groove 23*a*, 23*b* formed in their external cylindrical surface. Preferably, said rollers have a plurality of distinct grooves or, alternatively, a single helical groove having several spiral rings. The first solution, however, is preferred, because working of the roller surface in this case is easier. The strand bundle coming from the opposite intermediate rollers 17 runs through the inlet channel 20 to be wound onto the first winding roller 22*a*, along a corresponding groove 23*a*, and then onto a second winding roller 22*b*, along a corresponding groove 23*b* having an opposite rotation direction as compared with that of the preceding winding roller 22*a*. This path identified as a "figure eight" shaped path, can be repeated several times according to several turns about said roller. It is apparent that, in the presence of a helical groove, the strand bundle is wound in several turns (corresponding to the number of spiral rings) on both rollers, passing only once from the first to the second rollers. The strand bundle leaves the second winding roller 22*b* through the outlet channel 21 to reach the preformer 15, the wires 2*a*, 2*b* being disposed parallel in side by side relation.

Combined with the twister 16 is driving means 24 arranged to drive the rotating frame 19 in rotation, in a discordant rotation direction as compared with that of the impeller 5. In particular, said driving means 24 kinematically connects the twister 16 to the impeller 5 so that rotation of said impeller simultaneously causes driving in rotation of the twister itself, to a speed which is approximately twice that of the impeller. To this end, the driving means 24 contemplates the use of a first driving belt 25 operatively engaged between corresponding pulleys fitted on the impeller 5 and a propeller shaft 26 respectively (the shaft 26 is shown as discontinuous in FIG. 1, for the sake of clarity; the complete shaft is shown in FIG. 2). The shaft is rotatably supported within the nacelle 7 at a raised position laterally offset from the nacelle rotation axis. A second positive drive belt 27 is operatively engaged between other pulleys fitted on the propeller shaft 26 and an extension 19*b* of the hub-shaped element 19*a* carrying the outlet channel 21, respectively. The dimensional ratios between the pulleys associated with the first and second inlet belts 25, 27 respectively are selected such that the rotation speed of the rotating frame 19 is substantially twice, or in any case conveniently correlated with, the rotation speed of the impeller 5.

As a result of rotation of the rotating frame 19, the strand bundle 2*a*, 2*b* undergoes a false twist (apparent laying) at the twister inlet, which is eliminated at the twister outlet, so that the bundle of wires can become again separated from each other to be guided to the preformer disposed in parallel and side by side in a substantially coplanar relationship. However, each wire also is subject to a torsion about its own axis, the amount of which depends on the twister rotation speed.

In accordance with the present invention, it has been found that this torsion is capable of efficiently neutralizing the internal torsional stress (return torsion) which is transmitted to the wires 2*a*, 2*b* upstream of the first stationary intermediate roller 11 by effect of the double torsion acquired along the laying path on the rotating intermediate rollers, so that the wires pass on the preformer substantially in an untwisted condition and are then bendingly preformed along a generatrix disposed parallel to the wire axis.

In order to ensure accomplishment of a correct preforming on the individual wires 2*a*, 2*b* in spite of their difference in diameter, it is originally provided that a plurality of preforming seatings 28, 29 be arranged in the preformer 15, each of which is shaped and sized in conformity with one of the wires.

Figure 4:
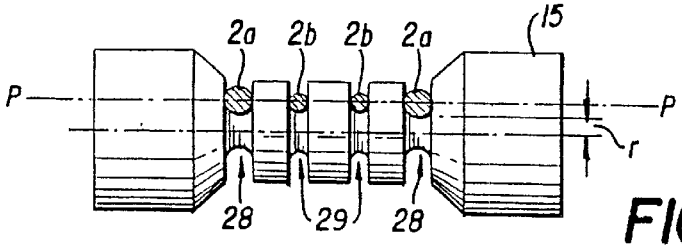
FIG. 4 is an enlarged view of a roller-type preformer utilized in the apparatus according to the invention.

As clearly shown in FIG. 4, these preforming seatings 28, 29 are defined by corresponding circumferential races formed at positions located in parallel and side by side relation on the cylindrical surface of the preformer roller 15 and each showing a depth correlated with the diameter of the corresponding strand 2*a*, 2*b*, so that the latter is deviated according to a radius of curvature "r" specifically selected depending on the diameter of the wire itself. In greater detail, as clearly viewed from FIG. 4, the preforming seatings are of a width substantially corresponding to the diameter of the corresponding wires 2*a*, 2*b* and have corresponding bottom surfaces of a semicircular profile with respective centers of curvature disposed in a common plane p-p. Then preforming can be controlled by varying either said radius of curvature, or (preferably) tension applied to the wire, that is, the traction action exerted by a capstan, the radius of curvature being equal (as already known).

Figure 5:
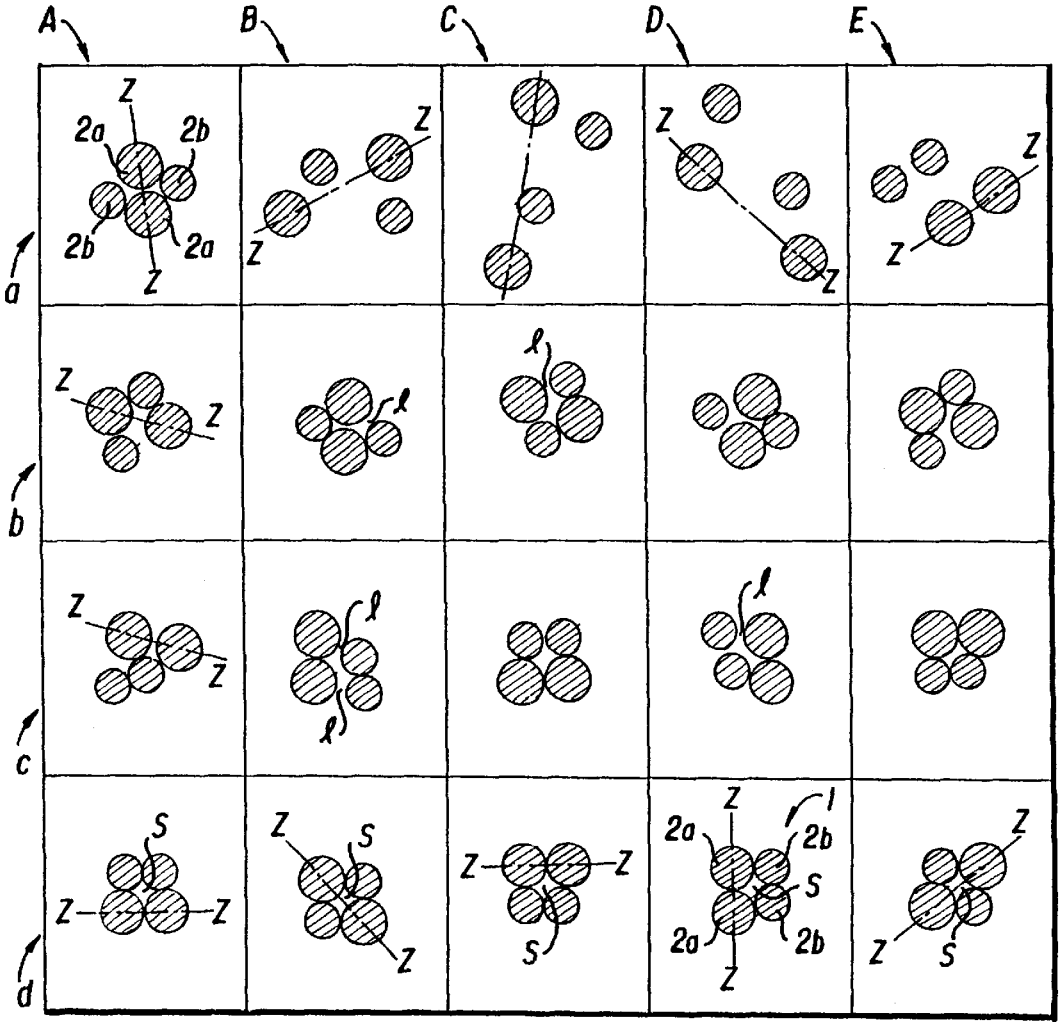
FIG. 5 is a comparison table in which each horizontal row corresponds to a given tractive load value applied to the cord, and each vertical column corresponds to a given cross sectional plane of the cord, the sectional planes corresponding to the five columns are of the same laying pitch.

The table in FIG. 5 shows the structural features of the cord 1 made in accordance with the present invention, and the behavior of same in operation, in relation to the increasingly growing tractive load applied thereto on passing from one rest condition, to which the complete absence of tensile stresses corresponds, to a use condition to which a tractive load higher than 5 kg is applied.

In this connection, vertical columns "A", "B", "C", "D" and "E" in FIG. 5 refer to respective transverse sections of the cord 1 taken within the same laying pitch, whereas the horizontal rows "a", "b", "c", "d" each represent the configuration taken by said sections at one specific tractive load applied to the cord 1. More particularly, row "a" refers to the cord 1 as such, that is, in the absence of stresses, row "b" corresponds to a tractive load of 3 kg, row "c" represents the cord 1 in a tractive load condition, with a load of 5 kg, whereas row "d" represents the cord 1 under any operating condition in which the tractive load exceeds 5 kg.

As can be seen by comparing sections "A", "B", "C", "D" and "E" along row "a", the cord 1 in the absence of tractive load has the wires 2*a*, 2*b* disposed according to a random configuration and loosely twisted, so that between one strand and the other there is much space left to enable free access to the blend employed during the rubberizing step of the cords, for example, when a rubberized fabric for carcass or belt plies of a tire is to be made.

From a comparison between sections "A", "B", "C", "D", "E", reproduced along rows "b" and "c", one can see that as the tractive load applied to the cord 1 increases, in relation to the specific rubberizing process employed, carried out on a calendar for example, the wires 2*a*, 2*b* tend to gather, but until the applied tractive load does not exceed 5 kg, in any portion of the cord 1 included within a single laying pitch, there is at least one right section having an inlet port, marked by "l", to enable access of the rubberizing material to the inside of the cord.

When the load exceeds 5 kg, that is, during the vulcanization and the use of the product, in particular in a tire, the wires 2*a*, 2*b* are each intimately in contact with at least two of the other wires, thereby causing elimination of the access ports "l" and a structural compaction in the cord 1.

Since the wires 2*a*, 2*b* are completely coated with the elastomeric material which has also penetrated the cord inside during the rubberizing step of the cord and/or the rubberized fabric, the space "s" existing between the wires of the cord 1 under use conditions will be completely filled with this elastomeric material, thereby eliminating any risk of early corrosion of the cord wires as a result of penetration of humidity or other external agents. In addition, a complete rubberizing of the wires 2*a*, 2*b* enables efficient inhibition of the undesired phenomena of mutual rubbing between the wires, which occur in particular in the cords employed in tire manufacture.

Advantageously, due to the action exerted by the twister 16, in the finished cord the wires 2*a*, 2*b* are substantially free of internal torsional stresses. Thus all problems connected with the presence of these internal stresses are eliminated, above all with reference to the cord cutting operations, in making rubberized fabrics such as carcass plies or belt strips for tires, or other semifinished products. In this connection, well known to persons of ordinary skill in the art, are the problems and difficulties encountered when, due to said internal stresses in the cords, the edges of a cut ply take an undulated appearance or are subjected to undesired strains.

Due to the random arrangement of the wires 2*a*, 2*b* in the cord section, made possible by the particular structure of the selected preformer 15 in accordance with the present invention, both in the rest and above all in the use conditions of the cord, in any portion of the longitudinal extension included within a laying pitch, there is at least one right section in which the wires 2*b* of the second pair, of smaller diameter, are located on the same side in relation to a direction Z-Z joining the centers of the first pair wires, and at least one right section in which the wires of said second pair 2*b* are located on respectively opposite sides in relation to said direction Z-Z.

By comparing the configurations taken by the individual sections in columns "A", "B", "C", "D", "E", it is also possible to ascertain that, in the cord in reference, as the applied tractive load progressively varies within a value range between 0 and 5 kg, the wires 2*b* of the second pair alternately pass from a situation in which they are disposed both on the same side in relation to said direction Z-Z, to a situation in which they are disposed respectively on opposite sides relative to said direction.

This feature has been found particularly efficient in ensuring a high stability of the cord and an even distribution of the efforts in the individual wires during use with high loads also of variable intensity, such as those applied to a tire in use.

The random arrangement of the wires makes the cord have diameter variations along its longitudinal extension. In a preferred embodiment, the cord 1 is provided to have, in the absence of tractive load, a maximum diameter between 1.15 mm and 1.27 mm, preferably equal to 1.21 mm and a minimum diameter between 0.54 mm and 0.48 mm, preferably of 0.51 mm.

Under tractive conditions with a load exceeding 5 kg, since, as said, all the wires are in mutual contact, the maximum and minimum diameters of the cord can be easily determined mathematically, the diameter of the individual wires used being known. In the cord made following the geometric and dimensional parameters specified in the description, the ultimate tensile strength is between 674 newtons and 551 newtons and corresponds to 613 newtons for example, to which, for steel wires having a carbon content of 0.7, an ultimate elongation between 2.5% and 3% corresponds. Thus, it can be proven that the laying process according to the invention has not at all impaired the mechanical strength of the cord as compared with that of the best cords known in the art.

The invention achieves the intended purposes.

In fact, the action of the twister within the nacelle imposes to the wires, in the portion of same coming out of the twister, a torsion in a direction opposite to that induced by the double twisting taking place along the laying path, thereby eliminating the internal torsional stresses and making it possible to carry out a more regular preforming of the wires, disposed in coplanar and parallel relation with respect to each other.

The achieved cord can be rubberized in an excellent manner due to the important gaps existing between the wires in a rest condition and, due to the absence of internal torsional stresses, has a better behavior when fabrics made using such a cord are to be submitted to further workings. At the same time, this cord has a compact structure under use conditions.

Such a compact structure is reached when, during the vulcanization step, for example, the cord is submitted to a tractive load exceeding 5 kg, and this compact structure is then maintained, following vulcanization of the elastomeric material.

The compact configuration thus eliminates all problems of structural instability appearing in known cords having two pairs of wires of different diameters, where the wires of smaller diameter keep a certain distance from the two other wires, even under use conditions.

The random arrangement of the wires 2*a*, 2*b* also eliminates all problems resulting, in the known art, from the necessity of imposing a well precise and definite geometric positioning to the wires, in the transverse section of the cord, so that the cord in accordance with the invention can be manufactured more easily, and its geometrical appearance can be more uniform and constant along its longitudinal extension.

As a result of the above, the tires 128 (FIG. 6) containing structural elements of rubberized fabric incorporating the cords of the invention as the reinforcing elements have an improved assembling capability, the mutual positioning of the semifinished products takes place more easily, and therefore the structure has more stability during the carcass-handling operations preceding the tire vulcanization, and the tire road behavior in use is ultimately improved.

In the finished tire, said cords, in addition, show more resistance to fatigue, less separations from the elastomeric rubberizing material and more resistance to corrosion, thereby prolonging the structural strength and lifetime of the tire.

In particular, said cord is preferably used as a reinforcing element for the belt structure in tires.

The tire 128 (FIG. 6) according to the invention shows the overall structure as previously defined in general, but in particular, it has a belt structure comprising two rubberized fabric strips 122 and 124 radially superposed on each other, substantially as wide as the tread, mutually staggered at the ends, reinforced with metallic cords disposed parallel to each other in each strip and symmetrically crossing those of the adjacent strip, relative to the equatorial plane of the tire.

Preferably, in a position radially external to said pair of strips, another layer of textile cords of heat-shrinkage material 126 is provided, which further cords are wound on said pair of strips in a plurality of coils disposed axially side by side and oriented in a direction substantially parallel to said equatorial plane, that is, according to the usual definition, at "0°" relative to equatorial plane.

Most preferably, as already disclosed, the reinforcing cords of said strips are the metallic cords of the invention, disposed inclined at an angle between 18° and 26° to the circumferential direction of the tire, distributed in each strip with a thickness of 80 to 120 cords/decimeter.

Obviously, once the invention as above described has been understood, a person skilled in the art will easily be able to make all necessary choices, changes and modifications in the features associated with the invention, in order to meet the specific technical requirements.

What is claimed is:

1. An apparatus for the manufacture of reinforcing metallic cords to be used, in particular, for composite articles of manufacture of elastomer material, comprising:

a bearing structure;

an impeller in engagement with the bearing structure and drivable in rotation about a given axis;

a nacelle oscillatably linked to the bearing structure by an oscillation axis coincident with the rotation axis of the impeller;

feeding means operatively mounted on said nacelle to feed a plurality of wires from respective supply reels, said wires being guided onto the impeller along a laying path having end stretches coincident with the rotation axis of the impeller and a central stretch spaced apart from said impeller rotation axis;

at least one preformer carried by the nacelle and acting on the wires over a portion thereof which is upstream of the first end stretch of the laying path, said apparatus further comprising at least one twister mounted on said nacelle and operating on at least one of said wires at a portion thereof upstream of the preformer to submit each strand to a torsional action about its own longitudinal axis, so as to neutralize internal torsional stresses induced in the wires by effect of the twisting action produced by said impeller.

2. An apparatus according to claim 1, in which said twister comprises: a supporting frame rigidly in engagement with said nacelle; a rotating frame rotatably in engagement with the fixed frame about a rotation axis substantially coincident with one stretch of the feeding path of said wires upstream of the preformer; and a pair of winding rollers rotatably carried by the rotating frame according to respectively parallel axes, said wires being successively wound about the first and second winding rollers in respectively opposite directions; driving means to operate the rotating frame in a rotation direction discordant from the rotation direction of the impeller.

3. An apparatus according to claim 2, in which said driving means kinematically connects the rotating frame with the impeller, so that rotation of the rotating frame is correlated with rotation of said impeller.

4. An apparatus according to claim 2, in which said driving means actuates the twister at a speed which is approximately twice the rotation speed of the impeller.

5. An apparatus according to claim 1, in which said preformer has a plurality of preforming seatings, each seating being suitably arranged for operatively engaging a respective wire.

6. An apparatus according to claim 5, in which said preformer includes at least one idler roller, said preforming seatings comprising circumferential races formed in said at least one roller.

7. An apparatus according to claim 6, in which each of said circumferential races is substantially as wide as a diameter of a corresponding wire and has a bottom portion of semicircular profile, the axis of which is in coplanar relation with that of the bottom portions of the other circumferential races.

* * * * *